US006384586B1

(12) United States Patent
Sugawara

(10) Patent No.: US 6,384,586 B1
(45) Date of Patent: May 7, 2002

(54) REGULATED LOW-VOLTAGE GENERATION CIRCUIT

(75) Inventor: Mitsutoshi Sugawara, Cupertino, CA (US)

(73) Assignee: NEC Electronics, Inc., Santa Clara, CA (US)

( * ) Notice: Subject to any disclaimer, the term of this patent is extended or adjusted under 35 U.S.C. 154(b) by 0 days.

(21) Appl. No.: 09/733,650

(22) Filed: Dec. 8, 2000

(51) Int. Cl.[7] ..... G05F 3/16
(52) U.S. Cl. ..... 323/313; 326/316
(58) Field of Search ..... 323/312, 313, 323/314, 315, 316

(56) References Cited

U.S. PATENT DOCUMENTS 4,443,753 A * 4/1984 McGlinchey ..... 323/313
4,447,784 A * 5/1984 Dobkin ..... 323/226
4,677,369 A * 6/1987 Bowers et al. ..... 323/314
5,053,640 A * 10/1991 Yum
5,612,613 A * 3/1997 Dutt et al. ..... 323/314
5,796,244 A * 8/1998 Chen et al. ..... 323/313
6,232,828 B1 * 5/2001 Smith et al. ..... 327/539
6,242,897 B1 * 6/2001 Savage et al. ..... 323/313

* cited by examiner

*Primary Examiner*—Adolf Deneke Berhane
(74) *Attorney, Agent, or Firm*—Skjerven Morrill MacPherson LLP

(57) ABSTRACT

A voltage reference generating circuit for providing voltage references substantially less than the typical 1300 mV, with a controllable thermal coefficient. By forcing equal-valued currents through two semiconductor junctions having disparate junction areas, a voltage differential is developed, as is a current proportional to the voltage differential. The voltage differential, and a current proportional to the voltage differential, have positive thermal coefficients. A third semiconductor junction is biased from a third current source and bridged by a resistor pair so as to synthesize a Thevenin-equivalent voltage equivalent series resistance. The equivalent voltage has a negative thermal coefficient. By forcing a current that is equal to the proportional current through the equivalent resistance, a reference voltage, equal to the sum of the Thevenin-equivalent voltage plus the voltage drop across the Thevenin-equivalent resistance, is created.

42 Claims, 3 Drawing Sheets

REGULATED LOW-VOLTAGE GENERATION CIRCUIT

BACKGROUND OF THE INVENTION

1. Field of the Invention

This invention relates to the design and fabrication of integrated circuit devices and, more particularly, to the design of a low-voltage reference generation circuit that provides low reference voltage with a controllable thermal coefficient.

2. Description of the Related Art

As is well known, bandgap voltage reference circuits are commonly deployed in the design of integrated circuit devices. The advantages associated with bandgap voltage reference circuits largely derive from the fact that such circuits are capable of providing a thermally stable voltage reference. In practice, the thermal coefficient of the voltage reference ideally approaches zero. An analysis of a number of embodiments of bandgap voltage reference circuits may be found in the textbook "Analog Integrated Circuit Design", by David A. Jones and Ken Martin (John Wiley & Sons), pp. 353–364, which is hereby incorporated by reference.

FIG. 1 depicts a bandgap voltage reference circuit that is considered to be representative of the state of the prior art. As may be readily observed, the bandgap voltage reference circuit depicted in FIG. 1 is realized through bipolar junction transistor technology, although other semiconductor device technologies, including MOS, may also be deployed. A realization of the invention based on MOS technology is described in detail in the Description below.

Referring now to FIG. 1, bipolar implementation of a bandgap voltage reference circuit is seen to include a current source $I_o$ that is coupled between a voltage source $V_s$ and the emitter of a pnp transistor Q44. Q44 is coupled in a common-collector configuration between $I_o$ and GND. The voltage reference also includes npn transistors Q41, Q42 and Q43, each of which has a collector coupled through a respective resistor, R42, R43 or R44, to the emitter of Q44 and to current source $I_o$. The emitters of Q41 and Q43 are directly connected to GND, while Q42 emitter is coupled to GND through resistor R41. The base electrodes of Q41 and Q42 are commonly connected Q41 collector. Q42 collector is in turn connected to Q43 base, and Q43 collector is connected to Q44 base. The output voltage, $V_{out}$, of the bandgap voltage reference circuit appears at the interconnection of $I_o$ and Q44 emitter.

In order to apprehend the operation of the bandgap voltage reference circuit of FIG. 1, assume for pedagogical purposes that the emitter area of Q42 is an order of magnitude (ten times) greater than the emitter area of Q41. Based on that assumption, an analysis of the operation of the bandgap reference circuit proceeds as follows. The base-to-emitter voltage of Q41, VBE(Q41), is identical to the voltage at Q41 collector. At room temperature, approximately 300° K., this voltage is roughly 700 mV. In addition, as may be readily understood from FIG. 1, the voltage at Q42 collector is equal to VBE(Q43). Consequently, the voltages across R42 and R43 are substantially equal. Therefore, if the resistance of R42 is designed to be equal to the resistance of R43, then the currents respectively flowing through these resistors must likewise be equal. As a result, the currents respectively flowing across Q41 and Q42 must be very nearly identical. From the above, and recalling that the emitter area of Q42 is an order of magnitude greater than the emitter area of Q41, it follows that:

$$I(Q41)=I_s e^{qVBE(Q41)/kT}=I(Q42)=10I_s e^{qVBE(Q42)/kT},$$

where I(Q41) is the current in Q41, and I(Q42) is the current in Q42.

In the above equation, $I_s$ is understood to be reverse saturation current at a specified temperature. It is well known that the reverse saturation current of a bipolar transistor is proportional to its base-to-emitter junction area. Because Q41 and Q42 are fabricated on the same die, according to the same process, and the base-to-emitter junction area of Q42 is ten times that of Q41, the reverse saturation current of Q42 is ten times greater than the reverse saturation current of Q41. Also, in the above equation:

K is Boltgman's constant, q is the charge of an electron, and

T is the absolute temperature.

Therefore, ΔVBE=VBE(Q41)−VBE(Q42)=(kT/q)ln 10.

At room temperature, ΔVBE is equal to 60 mV and has a positive temperature coefficient of 0.2 mV/°C. However, from inspection of FIG. 1, it is seen that ΔVBE is precisely the voltage across R41. If R43=10R41, then the voltage across R43 is 600 mV, with a temperature coefficient of 2 mV/°C. If VBE (Q43), the base-to-emitter voltage of Q43, has a magnitude of 700 mV, with a temperature coefficient of −2 mV/°C., then the reference voltage, $V_{out}$, will have a magnitude of 1300 mV with a zero temperature coefficient.

Accordingly, the prior art provides a technique for synthesizing a temperature-independent voltage reference that, as might be expected, has widespread utility in integrated circuit design. Additionally, the voltage reference is largely insensitive to semiconductor processing variations. However, the bandgap voltage reference circuit that is described above imposes an inherent design constraint that has become increasingly less tolerable as system designs have evolved. That is, because present designs develop a voltage reference, $V_{out}$, that is approximately 1300 mV, the voltage source, $V_s$, must be comfortably greater than 1300 mV in order to drive current source $I_o$. Although prior-art integrated circuit design and fabrication techniques have enabled operation from voltage sources as low as 1.5V, state-of-the-art designs are expected to be driven by power consumption and dissipation considerations to voltage sources as low as 1.2V, or even 1.0V. Clearly, what is required in order to operate from voltage sources as low as 1.2V, is a bandgap reference circuit design that generates a reference voltage much lower than the 1300 mV typically encountered.

SUMMARY OF THE INVENTION

The above and other objects, advantages and capabilities are achieved in one aspect of the invention by a circuit that generates a reference voltage having a magnitude less than the generally known silicon bandgap voltage. The circuit includes an amplifier having differential first and second inputs. Three current sources have control terminals coupled to the amplifier output and provide currents of equal magnitudes. The output of the first current source is connected to a first input of the amplifier, and is also coupled through a first junction device to GND. The output of the second current source is connected to a second input of the amplifier and is coupled through a second junction device and a resistance to GND. A third junction device is coupled between the output of a biasing device and GND. A voltage divider is coupled across the third junction device and has an output coupled to the output of the third current source.

Another aspect of the invention is manifest in a circuit for generating a voltage that is less than the semiconductor bandgap voltage. The circuit comprises voltage differential means, a feedback amplifier, first and second current sources, a voltage reference and a resistance element. The voltage differential means develops a voltage differential characterized by a temperature coefficient of a first polarity. A feedback amplifier has an input coupled to the voltage differential means. The first current source has a control terminal coupled to the output of the feedback amplifier and an output coupled to the voltage differential means. A voltage reference develops a voltage having a thermal coefficient of a second polarity, opposite to the first polarity. The second current source is also coupled at a control terminal to he output of the feedback amplifier, and has an output coupled to the voltage reference. The second current source provides a current in proportion to the voltage differential. The resistance element is coupled between the output of the second current source and the voltage reference so that a voltage is developed across the resistance element that is proportional to the current provided by the second current source. The voltage generated by the voltage generation circuit represents the sum of the voltage developed across the resistance element.

In a further aspect of the invention, a voltage generation circuit for generating an output voltage that is less than the semiconductor bandgap voltage comprises a differential amplifier having a noninverting input, an inverting input, and an output. A first semiconductor junction device is coupled between the inverting input of differential amplifier and GND, and a first current source has an output coupled to the inverting input of the differential amplifier and the first semiconductor junction device. A series -connected second semiconductor junction device and a first resistor are coupled between the noninverting input and GND. A second current source has an output coupled to the noninverting input and to the series-connected second semiconductor junction device and first resistor and GND. A voltage reference circuit establishes a voltage reference and equivalent series resistance. The voltage reference circuit comprises a third semiconductor junction device and a resistive divider coupled in parallel with that device. A third current source is coupled to the resistive divider so that the output voltage of the voltage generator circuit consists essentially of the sum of the voltage reference and the voltage across the equivalent series resistance.

In addition, the invention comprehends a method of generating an output voltage that is appreciably lower than the nominal silicon bandgap voltage, which is understood to be approximately 1300 mV. According to the method, a first current is provided to a first semiconductor junction device; and a second current, having a magnitude substantially equal to the magnitude of the first current, is provided to a series-connected second semiconductor junction device and first resistance. The second semiconductor junction device has a junction area that is greater (in a preferred embodiment, by approximately an order of magnitude) than the junction area of the first semiconductor junction device, so that the density of the current flowing through the first junction is proportionately greater than the density of the current flowing through the second semiconductor junction device. The first semiconductor junction device is coupled to the inverting input of a differential feedback amplifier; and the series-connected second semiconductor junction device and resistance are coupled to the noninverting input of the differential feedback amplifier. As a result, the voltage drop across the first semiconductor junction device is greater than the voltage drop across the second semiconductor junction device, and a voltage differential is developed across the first resistance. The magnitude of the second current is proportional to the voltage differential and has a temperature coefficient of a first polarity. A reference voltage is developed that is equivalent to a voltage source in series with the equivalent resistance formed by the parallel equivalent of two resistive elements. A third current, having a magnitude equal to the magnitude of the second current, is forced to flow through the equivalent resistance so that the voltage across the equivalent resistance is added to the reference voltage, thereby creating the output voltage. Because the temperature coefficient of the reference voltage has a polarity opposite the polarity of the temperature coefficient of the second current, the output voltage can be made to have a positive, negative, or zero temperature coefficient simply by selecting appropriate values for resistive elements.

BRIEF DESCRIPTION OF THE DRAWINGS

The present invention may be better understood, and its numerous objects, features, and advantages made apparent to those skilled in the art, with reference to the Drawings described below and attached hereto, in the several Figures which like reference numerals identify identical elements and where:

FIG. 3, including

DESCRIPTION OF THE PREFERRED EMBODIMENT(S)

For a thorough understanding of the subject invention, reference is made to the following Description, which includes the appended Claims, in connection with the above-described Drawings.

Figure 1:
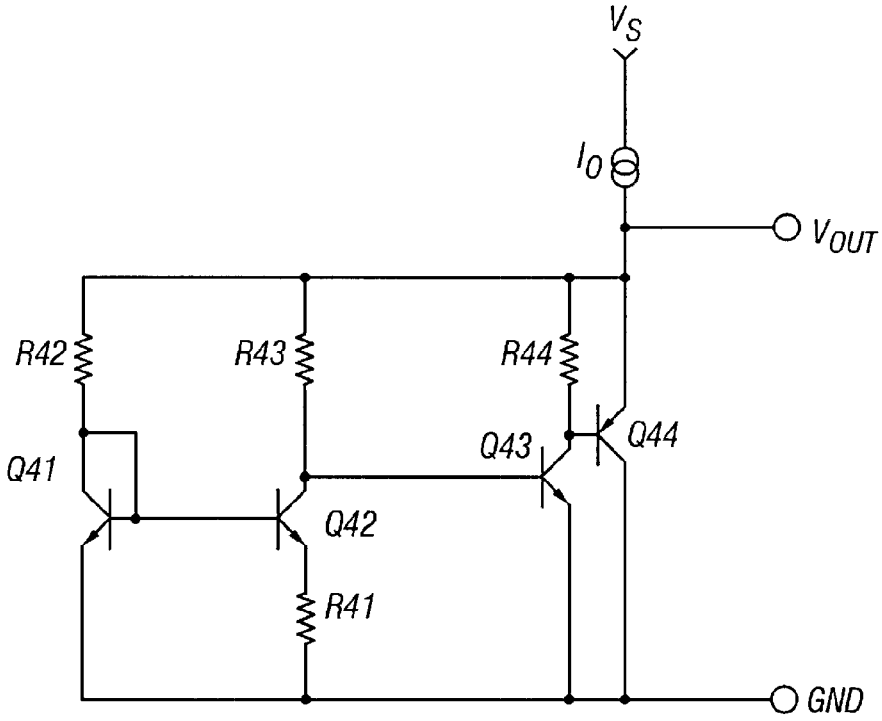
FIG. 1 is a circuit diagram of a voltage reference generation circuit that generates a voltage reference approximately equal to the bandgap voltage of a silicon semiconductor device, with a temperature coefficient approximately equal to zero.
Figure 2:
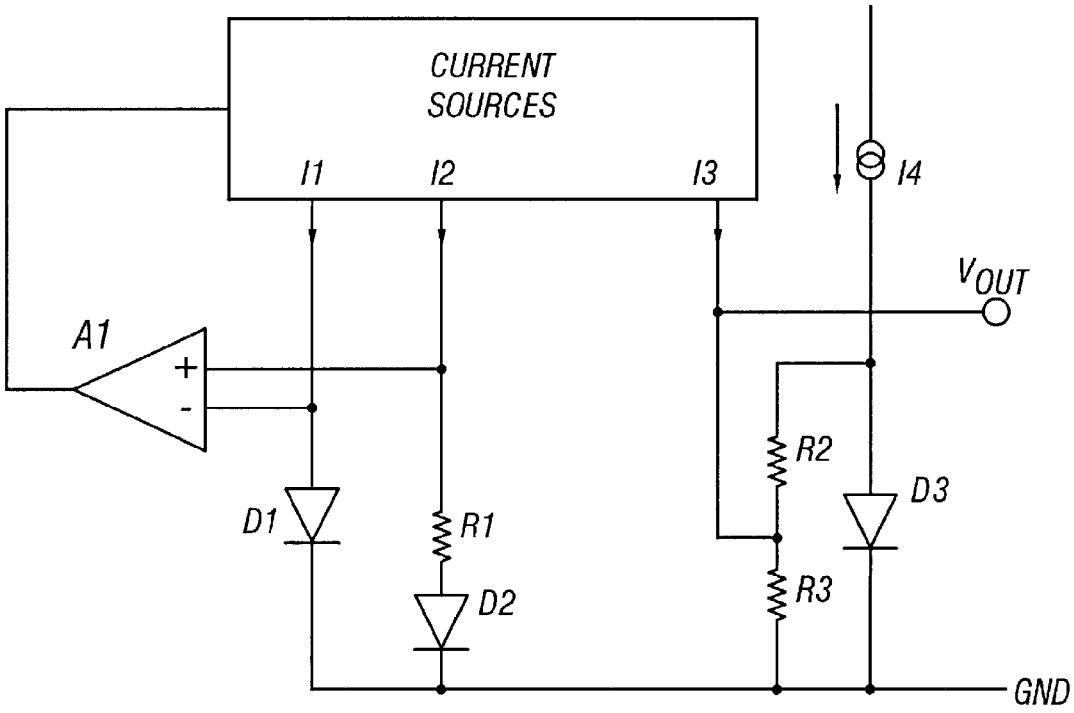
FIG. 2 is a circuit diagram depicting a generalized realization of a voltage reference generation circuit, in accordance with the present invention, that generates a reference voltage substantially less than the bandgap voltage of a silicon semiconductor device, with a controllable temperature coefficient.

Referring now to FIG. 2, which is a circuit diagram of a preferred embodiment of the invention, the invention can be seen to include a bank of current sources I1, I2 and I3, each supplying respective currents of equal value. I1 is coupled to the inverting input of an operational amplifier A1 and through diode D1 to GND. I2 is coupled to the noninverting input of A1 and through the series combination of resistor R1 and diode D2 to GND. I3 is coupled to a resistor R3 to GND and through a resistor R4 to a fourth current source I4. I4 is also coupled through a diode D3 to GND. Operation of the bandgap voltage reference circuit depicted in FIG. 2 may be understood with the assumption that the following conditions apply: (1) current sources I1, I2 and I3 supply currents of equal value; (2) the values of resistors R2 and R3 are equal, and are an order of magnitude greater than the value of resistor R1, which is equal to 1K ohm; and (3) that the junction area of junction diode D2 is an order of magnitude greater than the junction area of junction diode D1. Under these conditions, and applying the same analysis as applied above with respect to presently known bandgap voltage reference circuit:

$$\Delta V_f = V_f(D1) - Vf(D2) = {}^{kT}/_{qln10},$$

where Vf(D1) and Vf(D2) are the respective forward voltage drops across D1 and D2. Again, at room temperature, approximately 300° K., ΔVf=60 mV, with a positive temperature coefficient of 0.2 mV/°C.

From simple inspection of FIG. 2, it may be concluded that the voltage drop across resistor R1 will be approximately equal to ΔVf. To the extent that the characteristics of A1 approach the characteristics of an ideal operational amplifier, including infinite open-loop gain and infinite input impedance, the voltage across R1 will be equal to ΔVf. This result derives directly from the fact that the voltage across the inverting and noninverting input of A1 will, ideally, be forced to zero. Under the stated assumption, I1=I2=I3, it necessarily follows that the value of I2 is equal to $$\Delta Vf/R1 = (KT/q)(\ln 10/R1).$$

The voltage drop across D3, Vf(D3), is determined, at least in part, by the current supplied by current source I4. The magnitude of I4 current is not critical, but is designed to establish a nominal value for Vf(D3). At room temperature Vf(D3) is 700 mV, with a negative temperature coefficient of −2 mV/°C.

If the circuit consisting of D3 and the resistance pair R2 and R3 is reduced to its Thevenin equivalent, it becomes a voltage source of 350 mV, with a negative temperature coefficient of −1 mV/°C., in series with a resistance of 5K ohm, the parallel equivalent of R2 and R3. Because the current provided by current source I3 effectively flows through the (R2, R3) equivalent resistance, the voltage drop across that resistance is equal to (5K ohm) I3, which is in turn equal to (5) (kT/q) (ln 10). This value can be calculated to be equal to 300 mV, with a positive temperature coefficient of 1 mV/°C. Because the reference voltage generated by the bandgap voltage reference depicted in FIG. 2, $V_{out}$, is equal to Vf(D3) plus the voltage drop across the parallel equivalent of R2 and R3, $V_{out}$ is equal to 650 mV, with a temperature coefficient of zero. It is equal to one-half the standard bandgap reference voltage, and this voltage is sufficiently low so that the subject bandgap voltage reference circuit is compatible with the primary voltage sources as low as 1.0 V.

The specific example and analysis preferred above in the context of the bandgap voltage reference circuit depicted in FIG. 2 may be generalized to establish design guidelines according to which voltages references at desired levels, and with specified (negative, positive, or zero) thermal coefficients, may be realized.

Specifically, under the conditions where I2=(N)(I1) and I3=(P)(I2), and where the junction area of D2 is M times larger than the junction area of D1, then the following relationships may be easily shown to prevail:

$I1 = (I_s)\ (\exp[qVf(D1)/kT]$, and $I2 = MI_s\ (\exp[qVf(D2)/kT]$.

Therefore $\Delta Vf = V_f(D1) - V_f(D2) = (kT/q)\ln MN)$.

Also, again assuming approximately ideal characteristics for op-amp A1, ΔVf=(I2)(R1).

I3 is proportional to I2, with the proportionality relationship defined by:

$$I3 = (P)(I2) = (pkT/q)[(q)(InMN)/R1].$$

On the other hand, again applying elementary circuit theory, the Thevenin equivalent of the voltage across D3 reduces to a voltage source having a magnitude of [Vf(R3)]/(R2+R3), with an equivalent series resistance of (R2)(R3)/(R2+R3). Because the current provided by current source I3 effectively flows across this equivalent resistance, the generalized expression for the reference voltage, $V_{out}$, becomes:

$$V_{out} = [(Vf)(R3)/(R2+R3)] + [(kT/q)\ (P)(R2)(R3)/(R2+R3)/(R1)(lnMN)].$$

Because the first term has a negative thermal coefficient equal to −2R3/(R2+R3)mV/°C. and the second term has a positive thermal coefficient, a voltage reference with a positive, negative or zero thermal coefficient can be synthesized.

The above discussion articulates a generalized description and analysis of the subject invention: a bandgap voltage reference circuit that delivers a reference voltage significantly lower than the classical bandgap voltage of a silicon semiconductor device, with a controllable thermal coefficient. Given that description, those acquainted with the art will likely conceive of various instantiations of the invention. In this regard, a specific realization of the invention is embodied in the circuit that is detailed in FIG. 3. To wit: a bandgap voltage reference implemented through bipolar transistor technology.

Figure 3A:
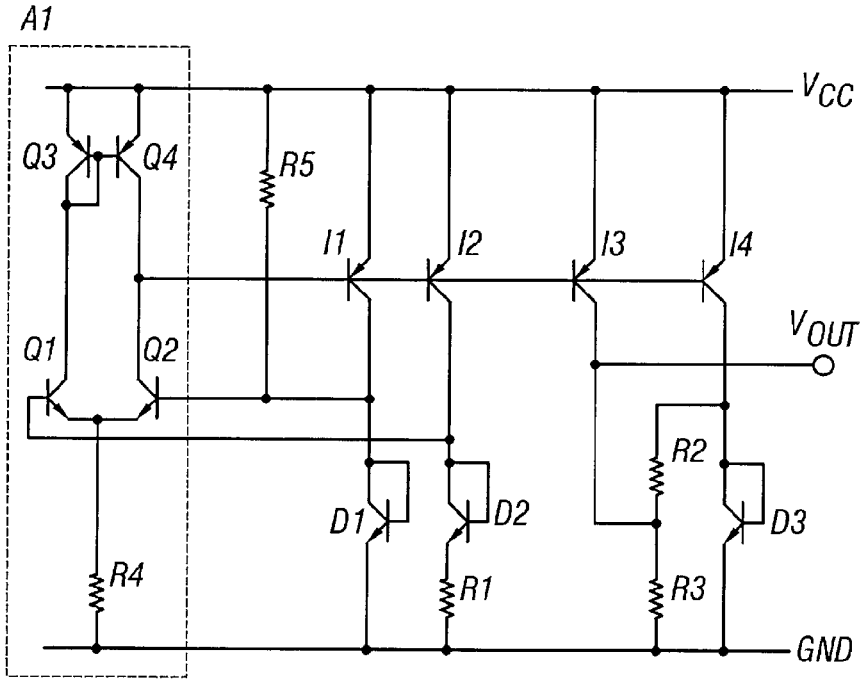
FIG. 3A and FIG. 3B, is a circuit diagram that depicts an implementation of the subject invention in bipolar-junction-transistor form.

Referring now to FIG. 3, and, more particularly to FIG. 3A, it is readily perceived that the circuit defined therein is a specific embodiment of the circuit depicted in FIG. 2. Amplifier A1 includes a differential input stage in the form of the npn transistor pair Q1 and Q2. Amplifier A1 incorporates an active load in the form of the current mirror consisting of the transistors Q3 and Q4. Resistor R4, coupled between the commonly connected emitters of Q1 and Q2 and GND, operates as a constant current sink. Diode D1, and the series connection of diode D2 and resistor R1, provide the inputs to the differential pair at the respective base terminals of Q2 and Q1. The output of amplifier A1, at Q2 collector, is applied directly to the input (base) terminals of current-source pnp transistors I1, I2, I3 and I4. The current sources supply respectively equal currents, and operate, for purposes germane to the invention, identically as described in the context of the corresponding current sources shown in FIG. 2.

Figure 3B:
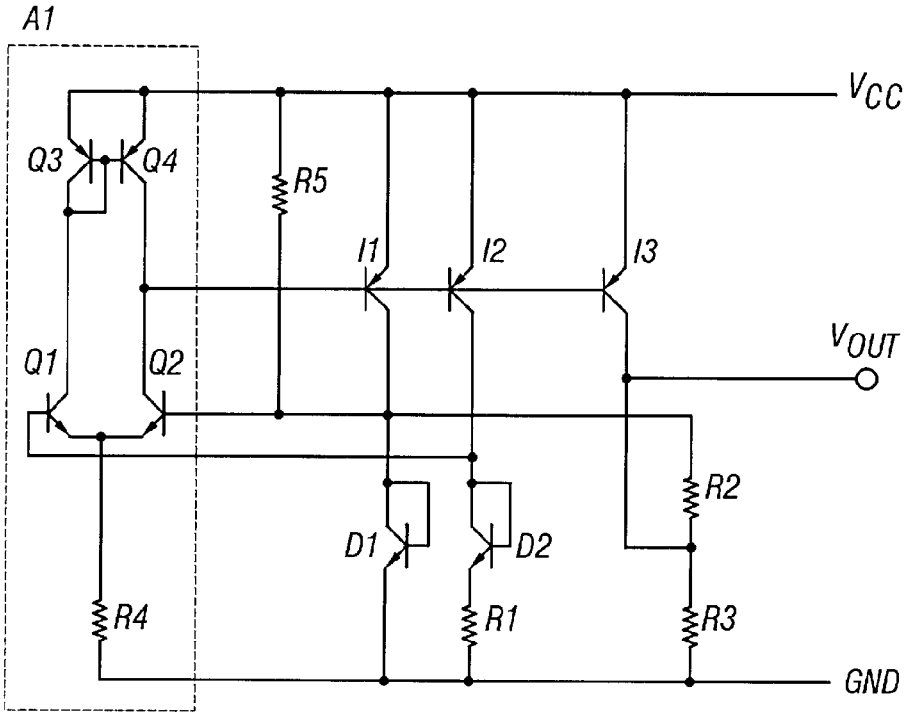

Although the bipolar voltage reference circuit shown in FIG. 3 conforms in all relevant respects to the generalized depiction of FIG. 2, the circuit of FIG. 3 includes ramifications not necessarily encountered in FIG. 2. First, note that current source I4 is included in the feedback loop of amplifier A1. Accordingly, if the magnitudes of resistors R2 and 23 are large, then the anode of D1 can be connected to R2, and current source I4 and the third junction device D3 may be eliminated. This configuration of the invention is depicted in FIG. 3B. In addition, the circuit shown in FIG. 3 includes a resistor, R5, coupled between the supply voltage, Vcc, and the base of Q2. R5 assures that the circuit will operate upon application of the supply voltage Vcc. This result might not otherwise occur if all transistors and diodes of the circuit of FIG. 3 are in cut-off mode (nonconducting) when the supply voltage is initially applied.

As indicated above, the voltage reference circuit of FIG. 3 operates substantially in accordance with the detailed analysis applied to the generalized circuit of FIG. 2. Specifically, if I1=I2=I3, if the base-to-emitter function area of D2 is ten times the area of D1, and if R2=R3=10R1, then the reference voltage, $V_{out}$, is equal to 650 mV, with a zero temperature coefficient.

As indicated earlier, the intended result of the invention is to provide a bandgap voltage reference circuit that operates from supply voltages of 1.0V or less. With this requirement in mind, it is useful to examine the circuit of FIG. 3 to determine whether the intended result is realizable. In this regard, it is safe to assume the current sources I1, I2, I3 and I4 will operate under the condition that their respective collector-to-emitter voltages are at least 50 mV. Because the voltage across D1 and D3 is roughly 700 mV, and the voltage across D2/R1 is 640 mV, adequate margin is available to assure the operation of the current source transistors. With respect to the differential pair Q1, Q2, note first that the voltage at the base of Q2 is 700 mV and its emitter voltage may be 60 mV. The voltage at the collector of Q2 is Vcc−Vf, where Vf for a pnp device is approximately 200 mV, yielding a Q2 collector-to-emitter voltage of 140 mV, representing a margin of 90 mV. Essentially the same analysis is applicable to Q1, suggesting that the voltage reference circuit of FIG. 3 will operate from a supply voltage, Vcc, of 810 mV. As an alternative perspective, if the supply voltage is maintained at 900 mV, then the voltage reference circuit will operate when the temperature falls 20° C. below room temperature, at which temperature $V_f$ will have increased by approximately 90 mV.

Figure 4:
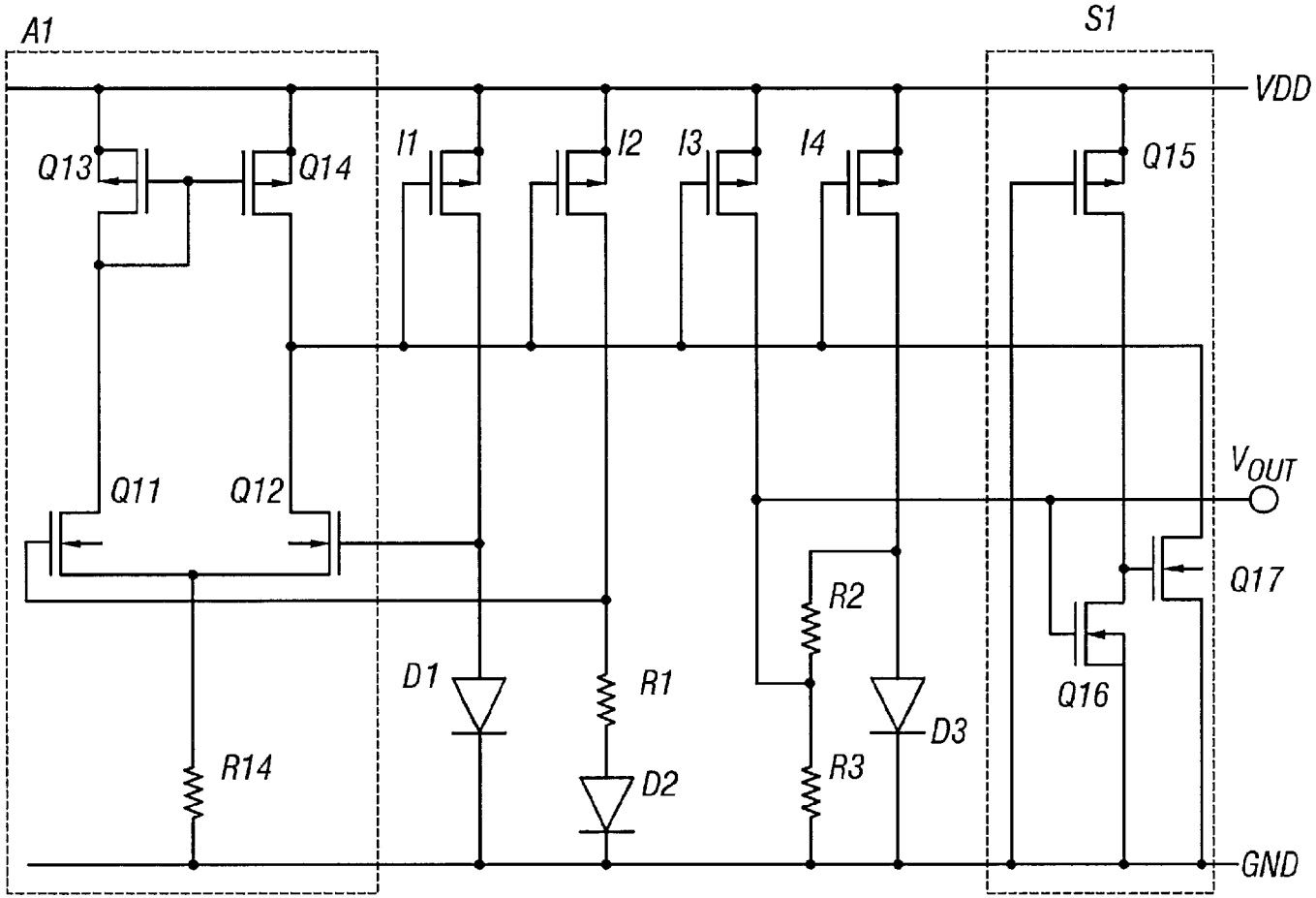
FIG. 4 is a circuit diagram of the subject invention implemented largely through MOSFET fabrication technology.

As may be seen from FIG. 4, the subject invention is amenable to implementation using MOS transistors, as well as the bipolar junction transistors utilized in the voltage reference generation circuit depicted in FIG. 3.

Referring now to FIG. 4, amplifier A1 includes a differential input stage constructed from an input pair consisting essentially of n-channel MOS transistors Q11 and Q12. The source terminals of the input pair are commonly connected and are coupled through a source resistor R14 to GND. R14 is a functional approximation of a common current sink for the input pair. Amplifier A1 drives an active load in the form of the current mirror consisting of transistors Q13 and Q14. Junction diode D1 is coupled between the gate input of Q12 and GND; and the series connection of diode D21 and resistor R1 is coupled between the gate input of Q11 and GND. The output of amplifier A1, at Q12 drain, is applied directly to the input (gate) terminals of current source transistors I1, I2, I3 and I4. The current sources supply respectively equal currents and operate, for purposes related to the subject invention, substantially equivalently with respect to the corresponding current sources depicted in FIG. 2 and FIG. 3, described above.

The circuit of FIG. 4 generates a reference voltage, $V_{out}$, in a manner equivalent to the operation of the generalized circuit depicted in FIG. 2, and to the bipolar implementation of FIG. 3. Specifically, current source I4, coupled to and driven by the output of amplifier A1, provides bias current to junction diode D3. The Thevenin equivalent of D3 and resistors R2 and R3 is a voltage source in series with a resistance. The series resistance is equivalent to the parallel combination of R2 and R3, R2//R3, so that $V_{out}$ is established by the divided—down voltage drop across D3, plus the voltage resulting from the current forced by current source I3 across R2//R3. The analysis applied to the circuits depicted in FIG. 2 and FIG. 3 is equally applicable to the MOS implementation shown in FIG. 4. That is, if current sources I1, I2 and I3 are identical, if the junction area of D2 is ten times as large as the junction area of D1, and if R2=R3 32 10R1, then Vout will be equal to 650 mV, one-half the magnitude of the silicon bandage voltage, with a temperature coefficient of 0 mV/°C.

As above, it is useful to assure the MOS circuit will operate at the required low voltages provided by the voltage supply VDD. For purposes of this analysis, assume that VDD is equal to 900 mV. If the current provided by I1, I2, and I3 is of sufficient magnitude, then the current sourcing transistors will operate with a source-to-drain potential of 50 mV. The voltage across D1 and D3 will be approximately 700 mV, and the voltage across R1/D2 will be 640 mV. Therefore, the current sourcing transistors will have approximately 150 mV latitude in the source-to-drain voltage adequate to ensure operation. With respect to the input pair, Q11 and Q12, of amplifier A1, it is known that the gate potential of Q12 will be 700 mV. Because the voltage between the gate and source of a MOS transistor is roughly 500 mV, the voltage at the source of Q12 will be approximately 200 mV. The voltage at the drain of Q12 will be equal to VDD, less the gate-to-source voltage of a PMOS transistor (approximately 500 mV): 400 mV. Accordingly, because under these circumstances, the drain-to-source voltage of Q12 is 200 mV, Q12 will operate with a 150 mV margin in the necessary operating voltage. A substantially similar analysis is applicable to the operation of Q1.

The MOS implementation in FIG. 4 includes a startup circuit, S1, that assures operation upon application of the voltage VDD form the power supply. The start-up circuit includes an NMOS transistor Q17 having a drain electrode connected to the common inputs of the current sources I1, I2, I3, and I4 and to the output of amplifier A1. The gate electrode of Q17 is coupled to the drain of an nMOS transistor Q16, whose gate is, in turn, coupled to the output of current source I3, at the tap of R2 and R3. The gate of Q17 and the drain of Q16 are coupled through pMOS transistor Q15 to VDD. As to operation, upon start-up, Q16 is nonconducting, but Q17 is biased on through Q15, causing current source transistors I1, I2, I3 and I4 to begin conducting. As a result, a bias voltage is applied to Q16 gate that is adequate to cause Q16 to begin to conduct current. With Q16 conductive, Q17 is forced to become nonconducting effectively disabling start-up circuit S1 during steady-state operation of the voltage reference generation circuit.

Although the invention has been described with respect to the specific exemplary embodiments set forth above, the invention is not necessarily limited to those embodiments. Various modifications, improvements, and additions may be implemented by those with skill in the art, and such modifications, improvements and additions will not depart from the scope of the invention, as defined by the appended Claims. For example, although the invention has been illustrated in FIG. 3 in the context of a bipolar semiconductor process, and in FIG. 4 in the context of an MOS process, the invention is not necessarily restricted to the specific semiconductor fabrication processes described above. In particular, the invention may be realized through a BiCMOS fabrication technology, thereby representing a hybrid of FIGS. 2 and 3. In addition, it is also possible to substitute pMOS transistors for the PNP transistors of FIG. 3.

What is claimed is:

1. A voltage generation circuit for providing a voltage that is less than the bandgap voltage, the voltage generation circuit comprising:

an amplifier having a first input and a second input;

respective first, second, and third current sources, supplying currents of substantially equal magnitudes, wherein the first current source is coupled to the first input of the amplifier and the second current source is coupled to the second input of the amplifier;

a first junction device coupled between the first input of the amplifier and GND;

a series-connected second junction device and resistance coupled between the second input of the amplifier and GND;

a third junction device coupled between a biasing device and GND; and a voltage divider coupled across the third junction device and having a node coupled to the third current source.

2. A voltage generation circuit for generating a voltage that is less than the semiconductor bandgap voltage, the circuit comprising:

voltage differential means for developing a voltage differential that has a temperature coefficient of a first polarity;

a feedback amplifier having an input coupled to the voltage differential means and having an output;

a first current source having a control terminal coupled to the output of the feedback amplifier and an output coupled to the voltage differential means;

a voltage reference for developing a voltage that has a temperature coefficient of a second polarity, opposite the first polarity;

a second current source having a control terminal coupled to the output of the feedback amplifier and an output coupled to the voltage reference, the second current source operable to provide a current in proportion to the voltage differential; and a resistance element coupled between the second current source and the voltage reference so that a voltage is developed across the resistance element that is proportional to the current provided by the second current source and so that the voltage generated by the voltage generation circuit represents the sum of the voltage developed by the voltage reference and the voltage developed across the resistance element.

3. A voltage generation circuit as defined in claim 2, wherein the feedback amplifier input comprises an inverting input and a noninverting input and wherein the voltage differential means comprises (i) a first voltage element coupled between the inverting input and GND and (ii) a second voltage element coupled between the noninverting input and GND.

4. A voltage generation circuit as defined in claim 3, wherein the first current source comprises (i) a first current element for providing a first current to the first voltage element and (ii) a second current element for providing a second current to the second voltage element.

5. A voltage generation circuit as defined in claim 4, wherein the magnitude of the first current is substantially equal to the magnitude of the second current.

6. A voltage generation circuit as defined in claim 2, wherein the feedback amplifier input comprises a noninverting input and an inverting input and wherein the voltage differential means comprises a first semiconductor junction device coupled between the inverting input and GND and comprises a series-connected second semiconductor junction device and resistance coupled between the inverting input and GND and comprises a series-connected second semiconductor junction device and resistance coupled between the noninverting input and GND.

7. A voltage generation circuit as defined in claim 6, wherein the first semiconductor junction device and the second semiconductor junction device are both pn-junction semiconductor diodes.

8. A voltage generation circuit as defined in claim 7, wherein the first current source comprises a first current element for providing a first current to the first semiconductor junction device and comprises a second current element for providing a second current to the series-connected second semiconductor junction device and resistance.

9. A voltage generation circuit as defined in claim 8, wherein the magnitude of the first current is substantially equal to the magnitude of the second current.

10. A voltage generation circuit as defined in claim 9, wherein the first current element consists essentially of a transistor having a control terminal coupled to the output of the feedback amplifier and an output terminal coupled to the inverting input of the feedback amplifier and to the first semiconductor junction device and wherein the second current element consists essentially of a transistor having a control terminal coupled to the output of the feedback amplifier and to the series-connected second semiconductor junction device and resistance.

11. A voltage reference circuit as defined in claim 7, wherein the first semiconductor junction device has a junction area that is larger than the junction area of the second semiconductor junction device.

12. A voltage generation circuit as defined in claim 11, wherein the first current source comprises a first current element for providing a first current to the first semiconductor junction device and comprises a second current element for providing a second current to the series-connected second semiconductor junction device and resistance.

13. A voltage generation circuit as defined in claim 12, wherein the magnitude of the first current is substantially equal to the magnitude of the second current.

14. A voltage generation circuit as defined in claim 13, wherein the first current element consists essentially of a transistor having a control terminal coupled to the feedback amplifier and an output terminal coupled to the inverting input of the feedback amplifier and to the first semiconductor junction device and wherein the second current element consists essentially of a transistor having a control terminal coupled to the output of the feedback amplifier and to the series-connected second semiconductor junction device and resistance.

15. A voltage generation circuit as defined in claim 7, wherein the voltage reference comprises:

a third semiconductor junction device;

a resistive divider coupled across the third semiconductor junction device and having a tap; and a second current source having a control terminal coupled to the output of the feedback amplifier and an output terminal coupled to the tap.

16. A voltage generation circuit as defined in claim 15, wherein the voltage reference further comprises a source of bias current for the third semiconductor junction device.

17. A voltage generation circuit as defined in claim 15, where the resistive divider forms an equivalent resistance in series between the second current source and the third semiconductor junction device so that the output voltage of the voltage generation circuit is substantially determined by the sum of (i) a voltage proportional to the voltage across the third semiconductor junction device and (ii) voltage that is equal to the equivalent resistance multiplied by the magnitude of the current provided by the second current source.

18. A voltage generation circuit as defined in claim 17, wherein the first current source comprises a first current element for providing a first current to the first semiconductor junction device and comprises a second current element for providing a second current to the series-connected second semiconductor junction device and resistance, wherein the magnitude of the first current is substantially equal to the magnitude of the second current.

19. A voltage generation circuit for generating an output voltage that is less than the bandgap voltage of a silicon semiconductor, the voltage generation circuit comprising:

a differential amplifier having a noninverting input, an inverting input, and an output;

a first semiconductor junction device coupled between the inverting input of the differential amplifier and GND;

a first current source having an output coupled to the inverting input of the differential amplifier and to the first semiconductor junction device;

a series-connected second semiconductor junction device and first resistor, coupled between the noninverting input of the differential amplifier and GND;

a second current source having an output coupled to the noninverting input of the differential amplifier and to the series-connected second semiconductor junction device and first resistor; and a voltage reference circuit for establishing a reference voltage and equivalent series resistance, the voltage reference circuit comprising a third semiconductor junction device and a resistive divider coupled in parallel with the third semiconductor junction device; and a third current source coupled to the resistive divider for causing current to flow in the resistive divider so that the output voltage of the voltage generator circuit is established by the sum of the reference voltage and the voltage across the equivalent series resistance.

20. A voltage generation circuit as defined in claim 19, wherein each of the first, second, and third current sources has a control terminal coupled to the output of the differential amplifier so that the magnitudes of respective currents provided by the first, the second, and the third current sources are substantially equal.

21. A voltage generation circuit as defined in claim 20, wherein the junction area of the second semiconductor junction device is greater than the junction area of the first semiconductor junction device so that a voltage differential, $\Delta Vf$ , is established across the first resistor and that voltage differential exhibits temperature coefficient of a first polarity.

22. A voltage generation circuit as defined in claim 21, wherein the reference voltage established by the voltage reference circuit exhibits a temperature coefficient of a second polarity, opposite the first polarity.

23. A voltage generation circuit as defined in claim 22, wherein the current that is caused to flow in the resistive divider is proportional to $\Delta Vf$.

24. A voltage generation circuit as defined in claim 23, wherein the reference voltage is established by biasing the third semiconductor junction device with the current provided by a current source so that a voltage drop is developed across the third semiconductor junction device and dividing the voltage drop across the third semiconductor junction divide by the resistive divider.

25. A voltage generation circuit as defined in claim 19, wherein the differential amplifier comprises an input differential transistor pair and an active load.

26. A voltage generation circuit as defined in claim 25, wherein the active load consists essentially of a pair of transistors arranged in a current-mirror configuration.

27. A voltage generation circuit as defined in claim 19, wherein the first, the second, and the third semiconductor junction devices each consists essentially of the base-to-emitter junctions of a bipolar transistor.

28. A voltage generation circuit as defined in claim 27, wherein each of the first, second, and third current sources has a control terminal coupled to the output of the differential amplifier so that the magnitudes of respective currents provided by the first, the second, and the third current sources are substantially equal.

29. A voltage generation circuit as defined in claim 28, wherein the junction area of the second semiconductor junction device is greater than the junction area of the first semiconductor junction device so that a voltage differential, $\Delta Vf$ , is established across the first resistor and that voltage differential exhibits temperature coefficient of a first polarity.

30. A voltage generation circuit as defined in claim 29, wherein the reference voltage established by the voltage reference circuit exhibits a temperature coefficient of a second polarity, opposite the first polarity.

31. A voltage generation circuit as defined in claim 30, wherein the current that is caused to flow in the resistive divider is proportional to $\Delta Vf$.

32. A voltage generation circuit as defined in claim 31, wherein the reference voltage is established by biasing the third semiconductor junction device with the current provided by a current source so that a voltage drop is developed across the third semiconductor junction device and dividing the voltage drop across the third semiconductor junction divide by the resistive divider.

33. A voltage generation circuit as defined in claim 32, further comprising a start-up circuit for assuring operation of the voltage generation circuit upon application of a power supply voltage.

34. A method of generating an output voltage lower than the semiconductor bandgap voltage, the method comprising the steps:

providing a first current to a first semiconductor junction device;

coupling the first semiconductor junction device to an inverting input of the differential amplifier;

providing a second current, substantially equal to the first current, to a series-connected second semiconductor junction device and first resistance, wherein the second semiconductor junction device has a junction area greater than the junction area of the first semiconductor junction device;

coupling the series-connected second semiconductor junction device and resistance to a noninverting input of the differential amplifier, whereby the voltage drop across the first semiconductor junction device is greater than the voltage drop across the second semiconductor junction device so that (i) a voltage differential is developed across the first resistance and (ii) the second current is proportional to the voltage differential and has a temperature coefficient of a first polarity;

developing a voltage reference in series with an equivalent resistance that is formed by at least two resistive elements, the voltage reference having a temperature coefficient of a second polarity, opposite to the first polarity; and causing a third current, equal to the second current, to flow through the equivalent resistance so that the output voltage is formed with a magnitude equal to the sum of the voltage reference and the voltage across the equivalent resistance.

35. A method of generating an output voltage as defined in claim 34, wherein the first, second and third currents are provided by respective first, second and third current sources, each of the aforementioned current sources having a control terminal coupled in common to an output of the differential amplifier.

36. A method of generating an output voltage as defined in claim 35, wherein the differential amplifier comprises a differential input pair of transistors and an active load.

37. A method of generating an output voltage as defined in claim 36, wherein the voltage reference is developed by biasing a third semiconductor junction device (D3) so that a voltage is developed across D3 and by coupling a resistive divider across D3, whereby the voltage reference appears at the output of the resistive divider.

38. A voltage reference circuit for providing a voltage reference less than the bandgap voltage reference, the voltage reference circuit comprising:

an amplifier having a first input and a second input;

respective first, second, and third current sources, supplying currents of substantially equal magnitudes, wherein the first current source is coupled to the first input of the amplifier and the second current source is coupled to the second input of the amplifier;

a first junction device coupled between the first input of the amplifier and GND;

a series-connected second junction device and first resistance coupled between the second input of the amplifier GND; and a resistive divider coupled between the first input of the amplifier and GND and having a node coupled to the third current source, wherein the voltage reference is the voltage at the node.

39. A voltage reference circuit as defined in claim 38, wherein the resistive divider comprises a second resistance coupled between the first junction device and the node and comprises a third resistance coupled between the node and GND, so that the voltage reference is equal to the sum of a first voltage that is proportional to the voltage across the first junction device and second voltage that is proportional to the current supplied by the third current source.

40. A voltage reference circuit as defined in claim 39, wherein the junction area of the first junction device is less than the junction area of the second junction device so that a voltage differential, $\Delta Vf$, is established across the first resistance and the voltage differential exhibits a temperature coefficient having a polarity opposite the polarity of the temperature coefficient of the voltage across the first junction.

41. A voltage reference circuit as defined in claim 40, wherein the current supplied by the third current source is proportional to the voltage differential so that the first voltage exhibits a temperature coefficient of a polarity opposite to the polarity of the temperature coefficient exhibited by the second voltage.

42. A voltage reference circuit as defined in claim 41, wherein the second resistance has a magnitude R2 and the third resistance has a magnitude R3 so that:

(i) the first voltage is proportional to (R3)(R2+R3) and the second voltage is proportional to [(R2)(R3)]/(R2+R3).

* * * * *